US005441467A

United States Patent [19]

Stevens

[11] Patent Number: 5,441,467

[45] Date of Patent: Aug. 15, 1995

[54] TWO-PIVOTAL-SECTION HANDLE ASSEMBLY FOR AN EXERCISER

[76] Inventor: Clive G. Stevens, 2F, No. 3, Alley 25, Lane 208, Jui-An St., Taipei City, Taiwan

[21] Appl. No.: 268,026

[22] Filed: Jun. 29, 1994

[51] Int. Cl.[6] ..... A63B 22/10

[52] U.S. Cl. ..... 482/54; 482/62; 482/70; 482/139

[58] Field of Search ..... 482/51, 54, 62, 70, 482/126, 139

[56] References Cited

U.S. PATENT DOCUMENTS 3,759,512 9/1973 Yount et al. ..... 482/62
5,139,255 8/1992 Sollami ..... 482/62

*Primary Examiner*—Lynne A. Reichard

*Attorney, Agent, or Firm*—Ladas & Parry

[57] ABSTRACT

A handle assembly includes two aligned handle units which are disposed on two sides of the base frame of an exerciser. Each of said handle units includes a lower handle section mounted pivotally on the base frame, and an upper handle section having a lower end connected pivotally to the upper end of said lower handle section by a horizontal pivot pin. Accordingly, when the handle units are operated by the hands of a user, the lower handle sections can rotate relative to the base frame. At the same time, the upper handle sections can rotate relative to the lower handle units. Accordingly, the arms of the user can be exercised in such a manner that the hands can be moved to be in front or back of the elbows, or to be above or below the same in order to operate the handle units during exercise.

1 Claim, 7 Drawing Sheets

TWO-PIVOTAL-SECTION HANDLE ASSEMBLY FOR AN EXERCISER

BACKGROUND OF THE INVENTION

1. Field of the Invention

This invention relates to a handle assembly for an exerciser, more particularly to a two-pivotal-section handle assembly with two handle units each of which includes a lower handle section pivoted to the base frame of the exerciser, and an upper handle section pivoted to the lower handle section.

2. Description of the Related Art

The improvement of this invention is directed to the conventional handle assemblies shown in FIGS. 1 and 2. Referring to FIG. 1, a handle assembly 1 is fixed on the elongated base frame 2 of an exerciser and cannot be used to exercise the arms of the user. FIG. 2 shows another handle assembly consisting of two handle units 3 which are mounted pivotally on two sides of the base frame of an exerciser and can effect a forward and rearward pivoting movement so as to afford an arm exercising effect to the user. However, because the handle units 3 can only rotate relative to the base frame, the lower arms of the user must be extended forwardly and exercised in front of his or her body during exercise. As a result, this arm exercising effect is limited.

SUMMARY OF THE INVENTION

It is therefore the main object of this invention to provide a handle assembly for an exerciser which has a pair of two-pivotal-section handle units so as to afford an increased arm exercising effect to the user.

According to this invention, a handle assembly includes two aligned handle units which are disposed on two sides of the base frame of an exerciser. Each of said handle units includes a lower handle section mounted pivotally on the base frame, and an upper handle section having a lower end connected pivotally to the upper end of said lower handle section by a horizontal pivot pin. Accordingly, when the handle units are operated by the hands of a user, the lower handle sections can rotate relative to the base frame. At the same time, the upper handle sections can rotate relative to the lower handle units. Accordingly, the arms of the user can be exercised in such a manner that the hands can be moved to be in front or back of the elbows, or to be above or below the same in order to operate the handle units during exercise.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
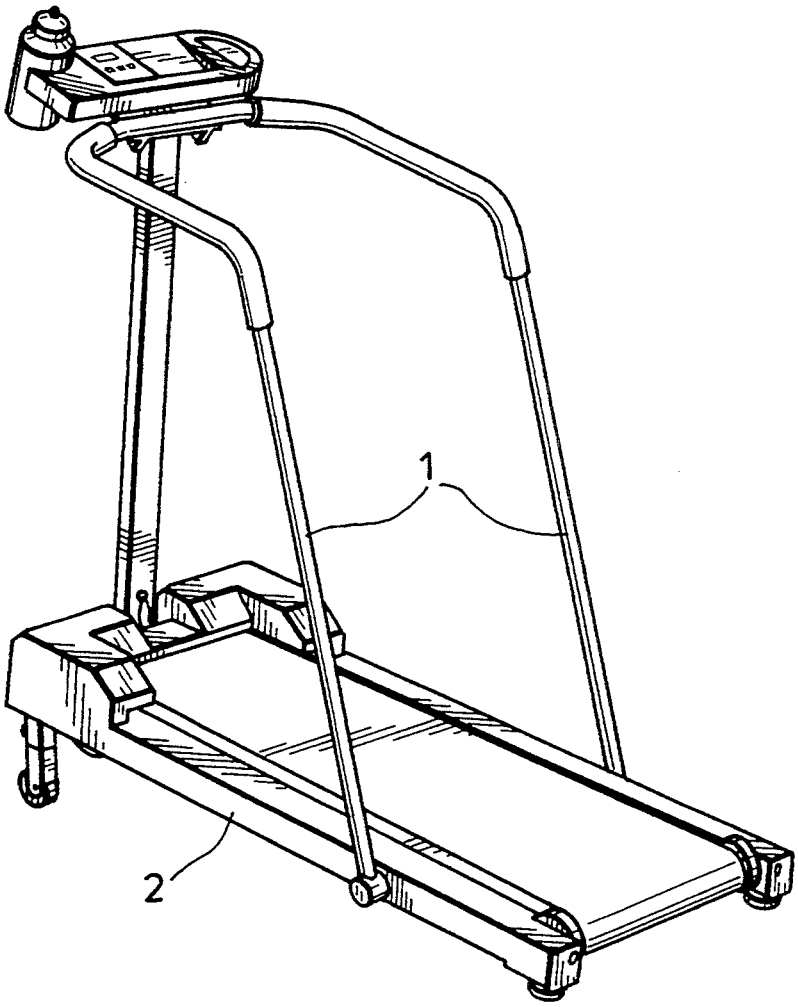
FIG.1 PRIOR ART
FIG. 1 illustrates a treadmill having a conventional handle assembly.
Figure 2:
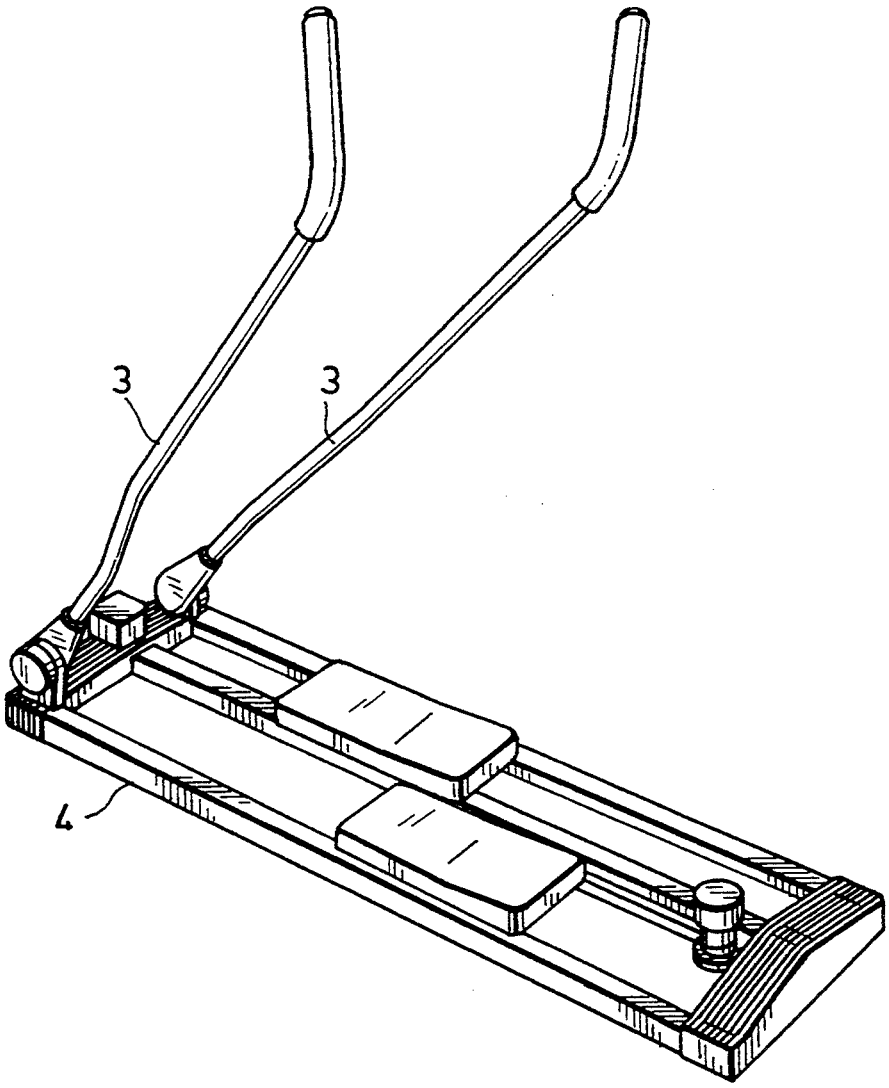
FIG.2 PRIOR ART
FIG. 2 illustrates a skier exerciser having another conventional handle assembly.
Figure 3:
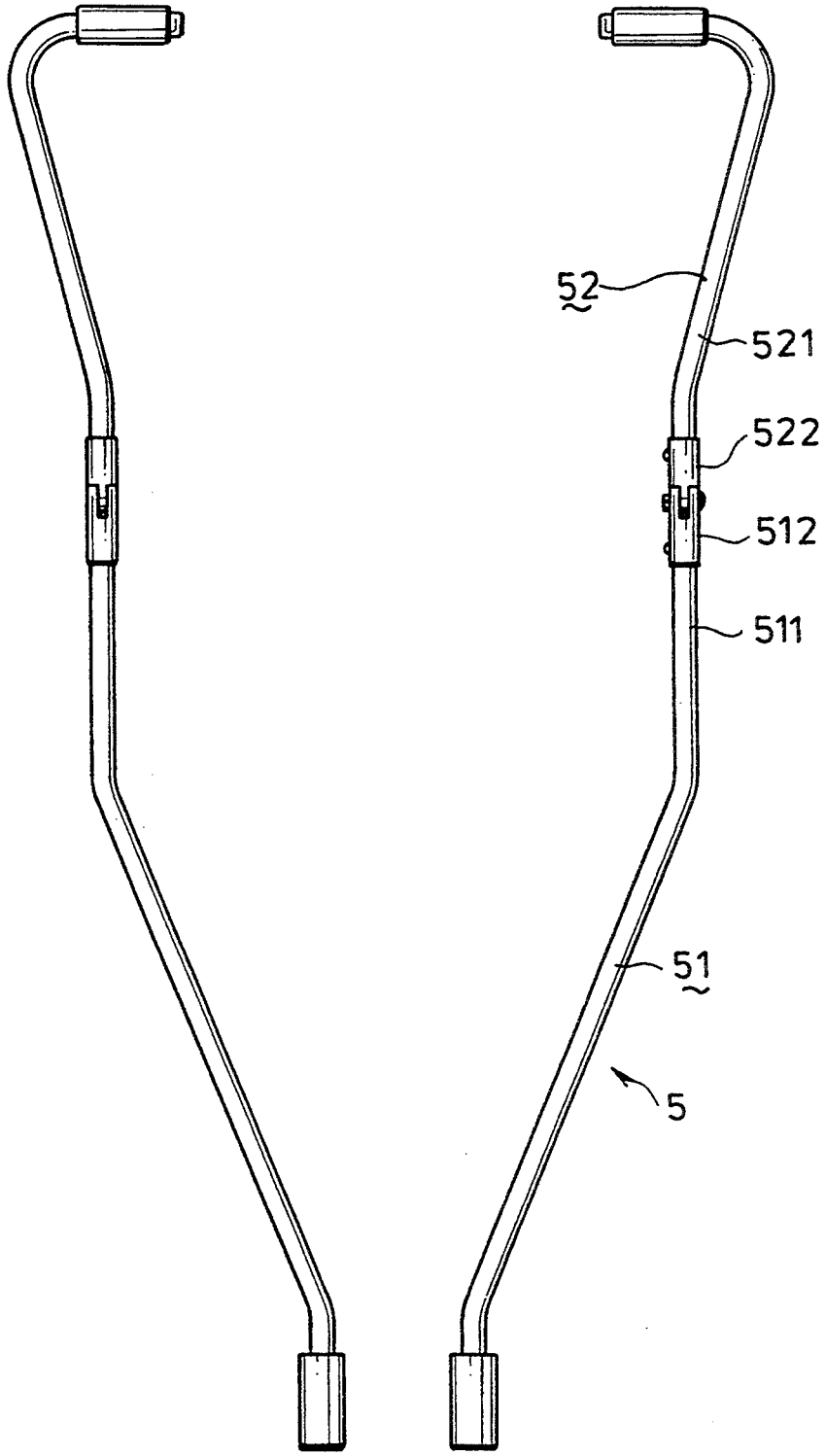
FIG. 3 illustrates a two-pivotal-section handle assembly for an exerciser according to this invention.

Referring to FIG. 3, a two-pivotal-section handle assembly of this invention includes two aligned handle units 5 each of which consists of a lower handle section 51 mounted pivotally on the base frame (not shown) in a known manner, and an upper handle section 52 connected pivotally to the upper end of the lower handle section 51.

Figure 4:
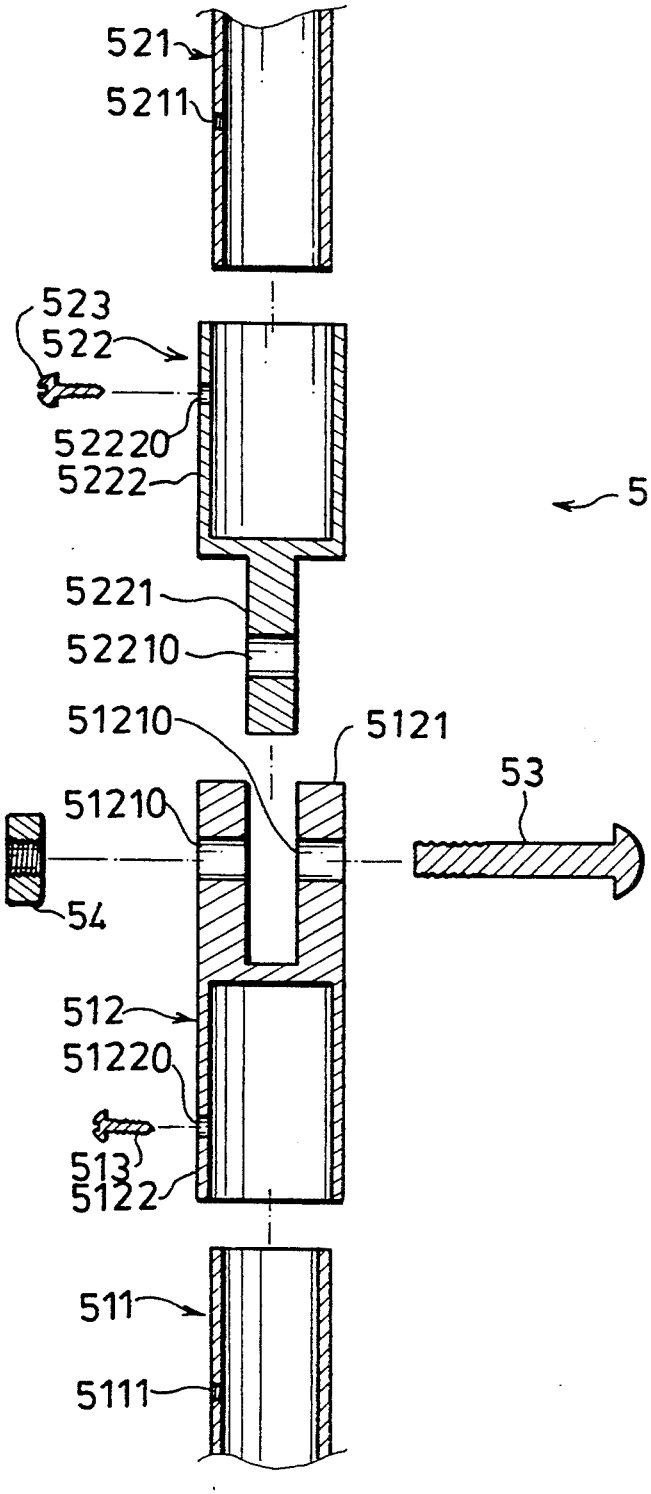
FIG. 4 is an exploded sectional view of a handle unit of the handle assembly according to this invention.
Figure 4A:
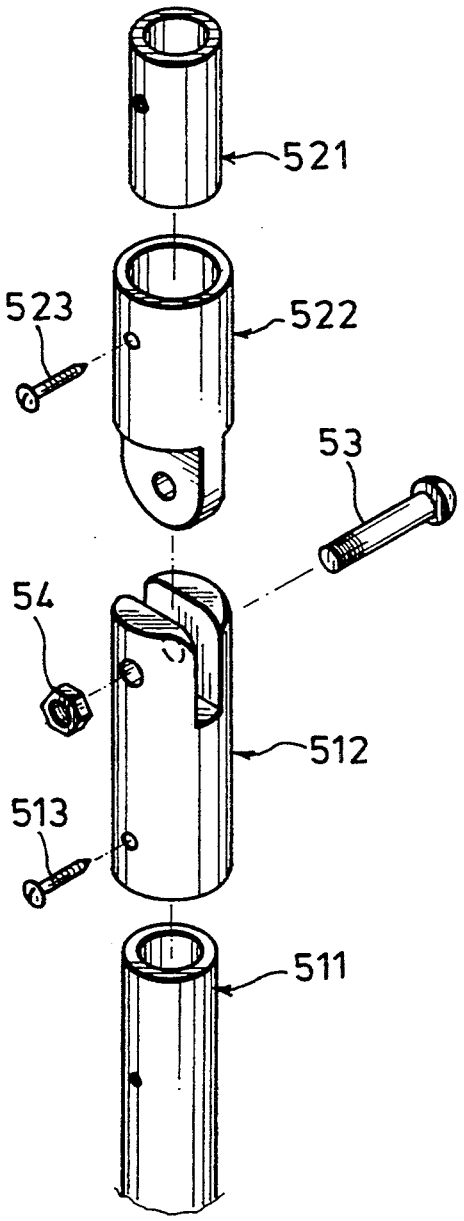
FIG. 4A is an exploded perspective view of the handle unit of the handle assembly according to this invention.

As best shown in FIGS. 4 and 4A, each of the lower handle sections 51 includes a metal lower tube 511, a plastic lower connector 512, and a lower lock bolt 513 locking the lower connector 512 on the lower tube 511. The lower tube 511 is pivoted to the base frame. A threaded radial hole 5111 is formed through a wall of the upper end portion of the lower tube 511. The lower connector 512 has a pivoting upper portion 5121 and a cylindrical hollow lower portion 5122 which has an open lower end sleeved on the upper end portion of the lower tube 511, and a closed upper end integrally formed with the lower end of the pivoting upper portion 5121. The cylindrical hollow lower portion 5122 has a radial lock hole 51220 formed through a wall thereof. The lower lock bolt 513 extends through the radial lock hole 51220 of the lower connector 512 to engage within the threaded radial hole 5111 of the lower tube 511.

Each of the upper handle sections 52 includes a metal upper tube 521, a plastic upper connector 522, and an upper lock bolt 523 locking the upper connector 522 on the upper tube 521. The upper tube 521 has a threaded radial hole 5211 formed through a wall of the lower end portion of the upper tube 521. The upper connector 522 has a pivoting lower portion 5221 and a cylindrical hollow portion 5222 which has an open upper end sleeved on the lower end portion of the upper tube 521, and a closed upper end integrally with the lower end of the pivoting upper portion 5221. The cylindrical hollow portion 5222 has a radial lock hole 52220 formed through a wall thereof. The upper lock bolt 523 extends through the radial lock hole 52220 of the upper connector 522 to engage within the threaded radial hole 5211 of the upper tube 521. A horizontal pivot pin 53 extends through the pivot holes 51210 of the lower connector 512 and through the pivot hole 52210 of the upper connector 522 to engage threadably with a lock nut 54.

Figure 5:
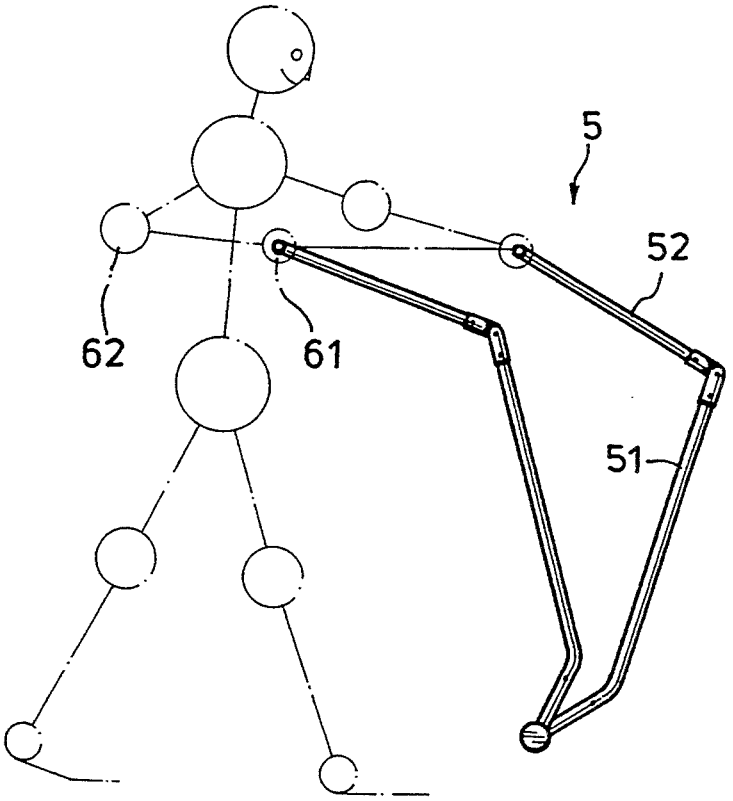
FIGS. 5 to 7 are schematic views illustrating the use of the handle assembly according to this invention.
Figure 6:
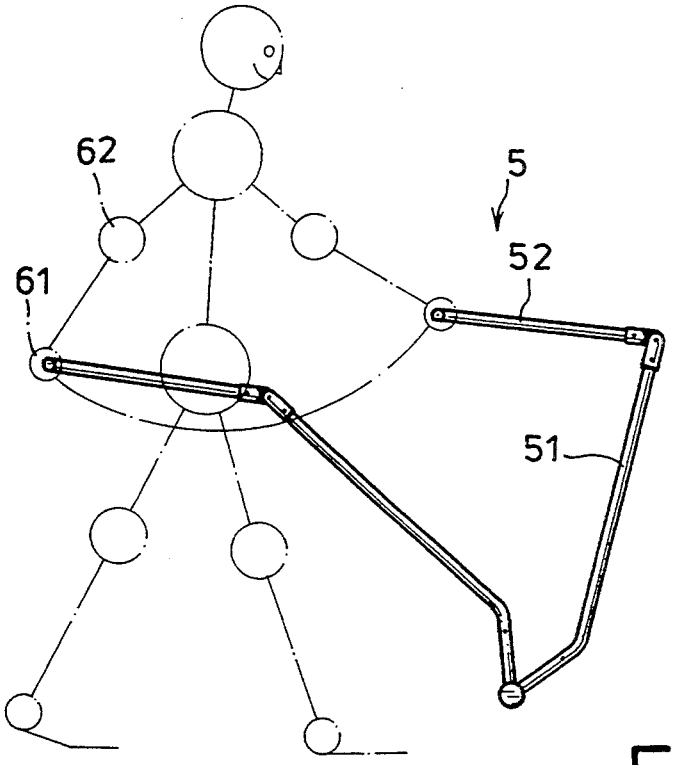
Figure 7:
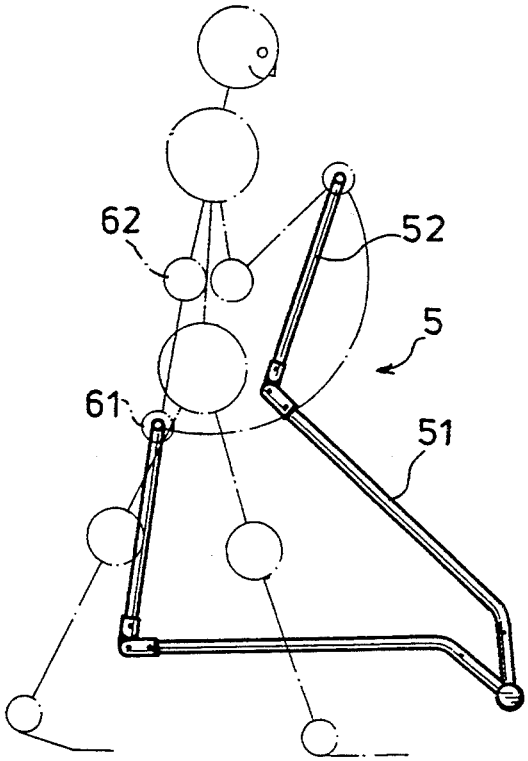

Referring to FIGS. 5 to 7, in use, when the handle units 5 are operated by the hands of a user, the lower handle sections 51 can rotate relative to the base frame. At the same time, the upper handle sections 52 can rotate relative to the lower handle units 51. Accordingly, the arms of the user can be exercised in such a manner that the hands 61 can be moved to be in front or back of the elbows 62, or to be above or below the same in order to operate the handle units 5 during exercise. In this way, the two-pivotal-section handle units 5 can provide an increased arm exercising effect to the user.

With this invention thus explained, it is apparent that numerous modifications and variations can be made without departing from the scope and spirit of this invention. It is therefore intended that this invention be limited only as indicated in the appended claims.

I claim:

1. An exerciser with a handle assembly, said exerciser having a base frame, said handle assembly comprising two handle units disposed on said base frame, each of said handle units including a lower handle section mounted pivotally on and above said base frame and an upper handle section having a lower end connected pivotally to an upper end of said lower handle section, wherein said lower handle section of each of said handle units includes:

a metal lower tube having a lower end portion pivoted on and above said base frame, and an upper end portion with a threaded radial hole formed therethrough;

a plastic lower connecting having a pivoting upper portion, and a cylindrical hollow portion having an open lower end and a closed upper end integrally formed with said pivoting upper portion so as to receive said upper end portion of said lower tube within said cylindrical hollow lower portion, said cylindrical hollow lower portion having a radial lock hole formed through a wall thereof; and a lower lock bolt extending through said lock hole of said lower connector to engage threadably within said threaded radial hole of said lower tube;

and said upper handle section of each of said handle section of each of said handle units includes:

a metal upper tube having a lower end portion with a threaded radial hole formed therethrough;

a plastic upper connector having a pivoting lower portion connected pivotally to said pivoting upper portion of said lower connector, and a cylindrical hollow portion having an open upper end and a closed lower end integrally formed with said pivoting lower portion so as to receive said lower end portion of said upper tube within said cylindrical hollow portion, said cylindrical hollow portion having a radial lock hole formed through a wall thereof; and an upper lock bolt extending through said lock hole of said upper connector to engage threadably within said threaded radial holes of said upper tube.

* * * * *